United States Patent [19]

Spencer, III et al.

[11] Patent Number: 5,010,833

[45] Date of Patent: Apr. 30, 1991

[54] EDGE DETECTOR FOR FELLING FOLDER AND METHOD

[75] Inventors: James T. Spencer, III, Greensboro; James K. Walker, Elon College, both of N.C.

[73] Assignee: Wrangler, Greensboro, N.C.

[21] Appl. No.: 240,859

[22] Filed: Sep. 6, 1988

[51] Int. Cl.[5] ..... D05B 35/10

[52] U.S. Cl. ..... 112/262.1; 112/153; 112/306; 112/147; 250/561

[58] Field of Search ..... 112/153, 147, 306, 121.11, 112/272, 141, 142, 262.1; 250/548, 561

[56] References Cited

U.S. PATENT DOCUMENTS

| | | | |
|---|---|---|---|
| 4,092,020 | 5/1978 | Blessing | 101/92 X |
| 4,146,797 | 3/1979 | Nakagawa | 250/548 |
| 4,481,507 | 11/1984 | Takiguchi et al. | 112/277 X |
| 4,531,466 | 7/1985 | Hanyu et al. | 112/121.11 |
| 4,612,867 | 9/1986 | Rosch et al. | 112/121.11 X |
| 4,653,414 | 3/1987 | Harrington | 112/306 X |
| 4,696,246 | 9/1987 | Rohr et al. | 250/561 X |
| 4,714,036 | 12/1987 | Raisin et al. | 112/147 |
| 4,766,828 | 8/1988 | Nomura et al. | 112/153 |

*Primary Examiner*—Peter Nerbum

*Attorney, Agent, or Firm*—Rhodes, Coats & Bennett

[57] ABSTRACT

An edge detector for detecting the edge of fabric in a textile folding or guiding device for an industrial sewing machine. The detector includes a light source mounted adjacent to one surface of the fabric as the fabric enters the folder. The light source is positioned for directing light onto the surface of the fabric. A photodetector is located adjacent to the light source for receiving light reflected from the surface of the fabric. The photodetector provides an output signal in response to the light reflected from the surface of the fabric which is indicative of the position of the fabric in the folder.

44 Claims, 3 Drawing Sheets

EDGE DETECTOR FOR FELLING FOLDER AND METHOD

BACKGROUND OF THE INVENTION

1. Field of the Invention

The present invention relates generally to devices for detecting an edge of material in a textile folding or guiding device and, more particularly, a device for detecting the edge of fabric in a folder for such sewing machines, such as a felling folder.

2. Description of the Prior Art

There are many critical applications in the manufacture of apparel. One particular application is the manufacture of lap seams, the type normally used in jeans, work clothes, and similar articles of apparel. The usual method of making such lap seams has been to feed the seam edges of two pieces of fabric through a 2-section folder to progressively fold such edges of material in an interlocking fashion. Two rows of stitches, each adjacent to one of the edges of the formed seam, are then added. If an excess width of material is fed into the folder, one or both pieces of material may be double-folded resulting in a roping effect or excessively thick lap seams. On the other hand, if an insufficient width of fabric is inserted in the folder, the folded edges of the material fail to interlock and a thin seam results. This condition, in which the short, underfolded material tends to snap out or unfold between the time the fabric leaves the folder and the time the seam is stitched, is called underloading. It is desirable to prevent the raw edges of fabric which occur with underloading since this condition results in a second quality garment.

In the past, it has been necessary to rely on the skill of the operator in order to produce the lap seam correctly. As a result, the felling operators are the highest paid workers in the sewing operation. Unfortunately, since such seams are often used in tube construction, the operator has no way of visually determining if the seam is made correctly and must rely on the "feel" of the garment as it is being made.

Some prior art folders have attempted to use mechanical means in controlling the loading condition. One example of such a mechanical device is disclosed in U.S. Pat. No. 4,395,963 issued to Diacont et al. However, such mechanical devices are known to be particularly delicate and are susceptible to malfunction. Also mechanical devices are subject to wear as well as vibration. Finally, these types of devices are too insensitive to detect the movement of a single-ply workpiece and do not provide the reliability required in these operations.

It also has been known to use optical scanners in applications which require the generation of a signal when a workpiece arrives at a predetermined location, such as for scanning flat, sheet-like material workpieces as they progress through a sewing machine. Such devices detect the edge of a piece of material on a reflective work surface having a coefficient of reflection different from the material workpiece being processed when the material interrupts a beam of light. Such devices have an emitter and a detector in positions for the detector to receive the reflection by the work surface of light emitted by the emitter, generally on the sewing head above the material being sewn on the sewing machine. Thus, this design actually functions as a "folded" transmission mode photocell arrangement. One example of such a device is disclosed in U.S. Pat. No. 4,423,691, issued to Schwaab.

Certain disadvantages become apparent with such a design. Reflection from a shiny surface is mostly specular, rather than diffused (i.e., the angle of incidents is equal to the angle of reflection). As a result, the sensor must be mounted almost exactly perpendicular to the shiny surface for reliable sensing. Secondly, the requirement for precise positioning also makes such devices particularly sensitive to vibration. Finally, because these devices detect the edge of a piece of material when the beam of light reflected back from the work surface is interrupted, such devices are unable to detect the presence of fabric work pieces which have a coefficient of reflectivity similar to the surface of the work surface. As a result, such devices are particularly unreliable when fabric is highly reflective, such as white cloth, or when the front and back of the material have different reflectivities, such as denim.

It has thus become desirable to develop an edge detector for detecting the passage of the edge of a workpiece through a sewing machine which does not require precise positioning of the detector. In addition, it has become desirable to develop a edge detector which is insensitive to vibration. Finally, it has become desirable to develop an edge detector which is able to detect the edge of fabric work pieces having a wide degree of reflectivity and which is simple to install, use, and maintain.

SUMMARY OF THE INVENTION

The present invention solves the aforementioned problems associated with the prior art by providing an edge detector for detecting the passage of a fabric workpiece through a sewing machine which does not require precise positioning with respect to the work surface and which is capable of detecting the edge of fabric workpieces having different reflectivities. The edge detector includes a light source mounted adjacent to one surface of the fabric for directing light onto the surface of the fabric as the fabric passes through a guide on the sewing machine. A photodetector is located adjacent to the light source receiving light reflected from the surface of the fabric workpiece. The photodetector provides an output signal in response to the light reflected from the surface of the fabric which is indicative of the presence of the fabric edge. The surface of the work surface opposite the light source is blackened, matted, or otherwise made non-reflecting. Thus, removal of the partially reflective fabric workpiece results in interruption of the output signal.

Accordingly, one aspect of the present invention is to provide an edge detector for detecting the presence of the edge of a work piece through a sewing machine.

Another aspect of the present invention is to provide a felling folder detector for providing a signal indicative of the position of a fabric fed into the folder.

Another aspect of the present invention is to provide a control system for a sewing machine employing a folder that is operable to provide a display in the event an underloading condition exists in the seam produced by the sewing machine.

These and other aspects of the present invention will be more clearly understood after review of the following description of the preferred embodiment of the invention when considered with the following drawings.

DESCRIPTION OF THE PREFERRED EMBODIMENT(S)

Figure 1:
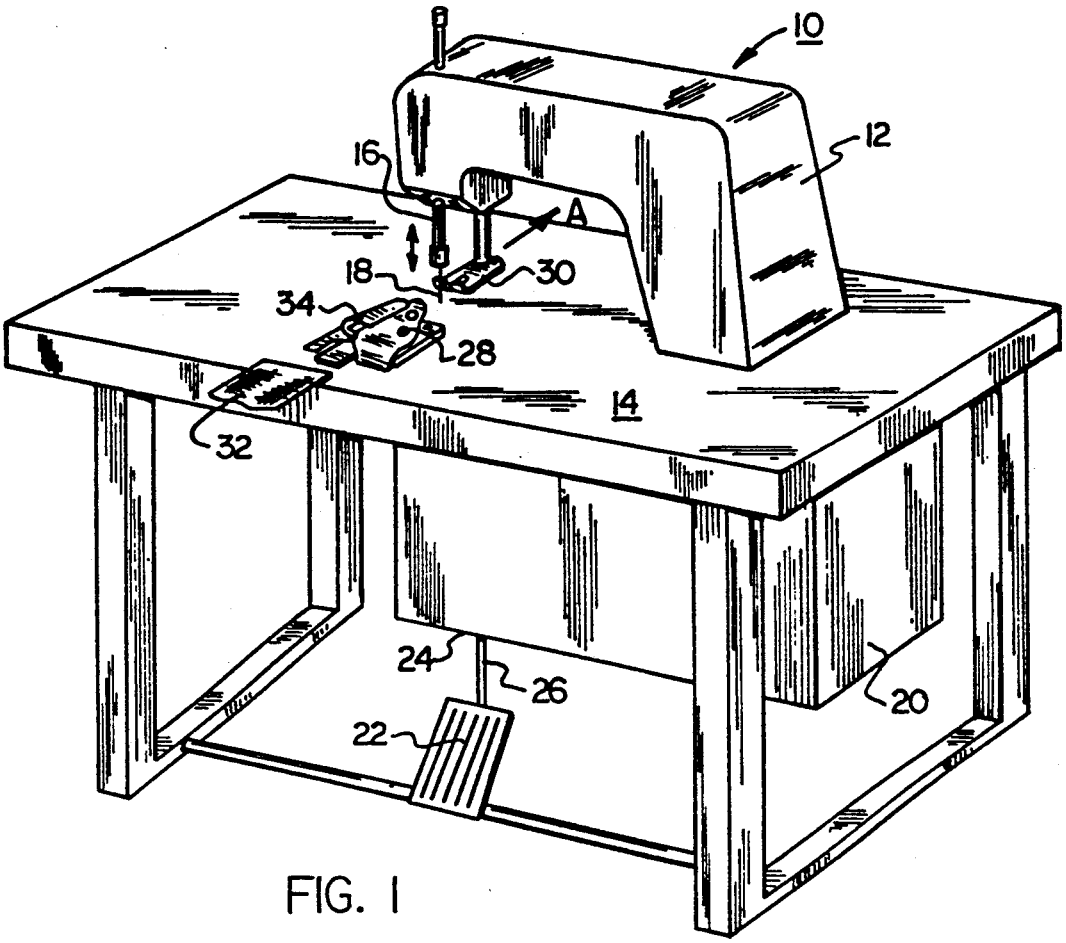
FIG. 1 is a front elevational view of a modified industrial sewing machine illustrating the location of the edge detector of the present invention.

Referring to the drawings, it will be understood that the illustrations are for describing a preferred embodiment of the invention and are not intended to limit the invention hereto.

As best seen in FIG. 1, a conventional industrial sewing machine, generally designated 10, is shown. The sewing machine head 12 extends over work surface 14. Sewing head 12 includes needle bar 16 and at least one needle 18. A drive unit, generally designated 20, is mounted beneath work surface 14. A treadle switch pedal 22 is attached to motor drive switch 24 by linkage 26. Motor drive unit 20 is actuated in response to the operator's pressure on the treadle switch pedal 22. A conventional fabric folder, for example, a felling folder 28, is located adjacent to a presser foot 30 and directly in the path of movement of workpiece 32, the direction of which is shown by arrow A. Edge detector assembly of the present invention, generally designated 34, is preferably attached to folder 28 and is located as close to presser foot 30 as possible based on geometrical contraints. Edge detector 34 provides a first output signal 36 which is indicative of the passage of workpiece 32 through folder 28. In the preferred embodiment, drive control switch 24 is utilized to provide a second output signal indicative of the operation of machine 10.

Figure 2:
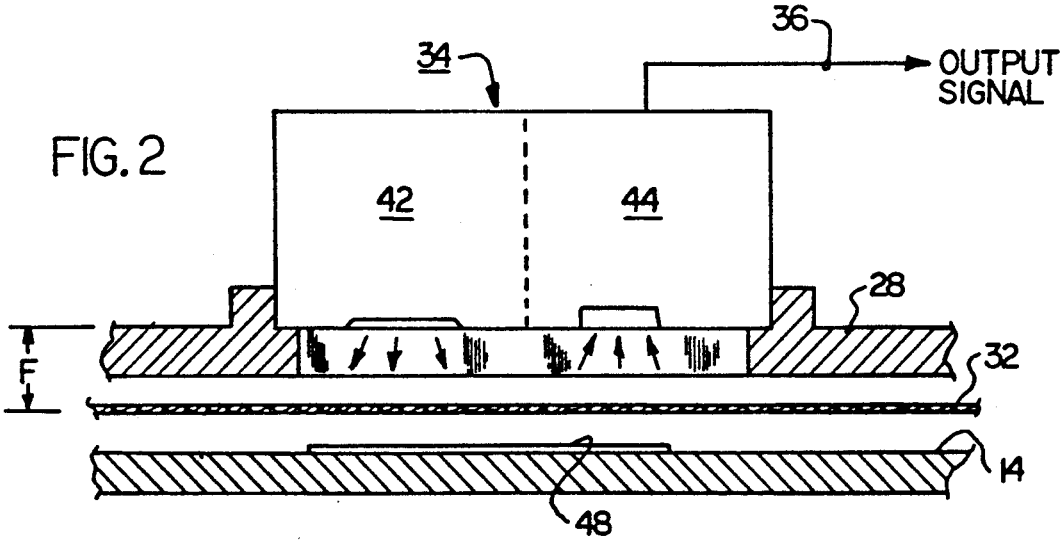
FIG. 2 is a side sectional view of a simplified edge detector assembly illustrating its operation.

Turning now to FIG. 2, an enlarged side sectional view of a simplified edge detector assembly 34 is shown illustrating its operation. Edge detector assembly 34 includes an light source 42 and a photodetector 44. In the preferred embodiment, the light source 42 and detector 44 are combined in a single unit. Light source 44 preferably is an infrared light emitting diode. An edge detector assembly viewport 46 extends through folder 28, thereby allowing light from light source 42 to impinge on one surface of workpiece 32. Photodetector 44 is positioned such that light reflected off the surface of workpiece 32 is received by detector 44. In the preferred embodiment, photodetector 44 is positioned at a distance "F" substantially equal to the focal length of photodetector 44.

Photodetector 44 provides an electrical output signal 36 in response to the presence of reflected light from workpiece 32. In order to prevent spurious signals being reflected back from work surface 14, a light absorbing region 48 is applied to the surface of workpiece 14 opposite edge detector assembly 34. Light absorbing region 48 may be a blackened, anodized or matte surface. In addition, depending on the geometry of work surface 14, light absorbing region 48 may simply be an aperture that allows light from light source 42 to pass through work surface 14 when workpiece 32 is not present.

Modulated visible (650 nm) light is preferred for the source 42 and sensitivity to the specific frequency of the light is preferred for the detector 44 in order to avoid false readings from ambient light while still permitting quick, visual sensor alignment and trouble shooting. However, other portions of the electromagnetic spectrum can be used.

It was surprisingly discovered that the present invention was able to detect the presence of fabric workpieces having a wide range of reflectivity. Experiments were performed using the present invention measuring the relative strength of output signal 36 for various workpieces 32. The results of these tests are summarized in the following table:

| Fabric | None | Blue Denim (Back Face) | Blue Denim (Front Face) |
|---|---|---|---|
| % Full Scale Signal Value-Work Surface Reflective Mode (Prior Art) | 100% | 40% | 20% |
| % Full Scale Signal Value-Workpiece Reflective Mode (Invention) | 0% | 100% | 50% |

As can be seen, the prior art work surface reflective mode is able to distinguish between the presence of a black or dark fabric and no fabric, but is unable to resolve fabrics which are partially reflective such as the back face of denim. In contrast, when operated in the workpiece reflective mode, the edge detector of the present invention is able to distinguish between reflective fabrics, including the back face of denim and, in addition, is also able to detect darker fabrics such as the front face of denim. Thus, the present invention is able to detect the presence of workpieces having a wide range of reflectivity which would have gone undetected by prior art devices.

Figure 3:
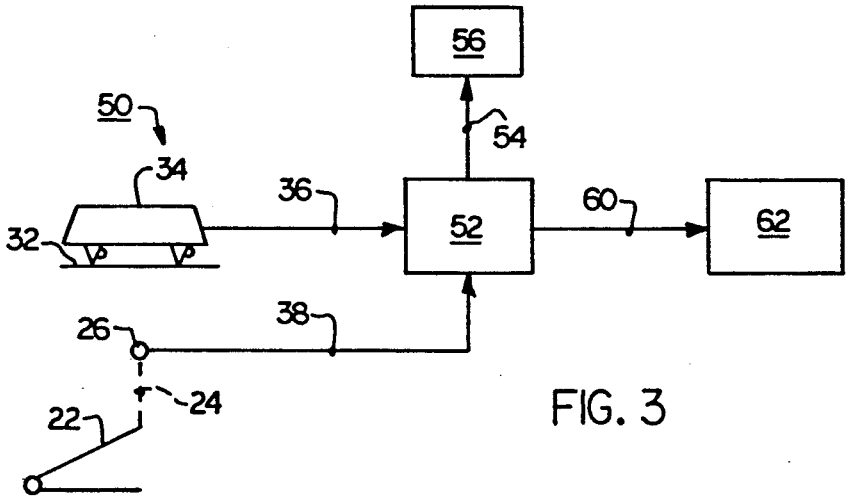
FIG. 3 is a schematic representation of a control system for a sewing machine using the present invention.

As best seen in FIG. 3, a schematic representation of a control system, generally designated 50, for sewing machine 10 utilizing edge detector assembly 32 is illustrated. Detector signal 36 is received by a controller 52. Controller 52 also receives second control signal 38 from drive control switch 24. In the event that output signal 36 indicates the absence of workpiece 32 and switch 22 is activated, controller 52 will provide a third output signal 54 to visual alarm means 56 and, at the same time, provide a fourth output signal 60 to audio alarm means 62, thereby alerting the operator. Controller 52 can be any suitable conventional control device, such as a control circuit, programmable controller, computer, microprocessor, or the like.

Figure 4:
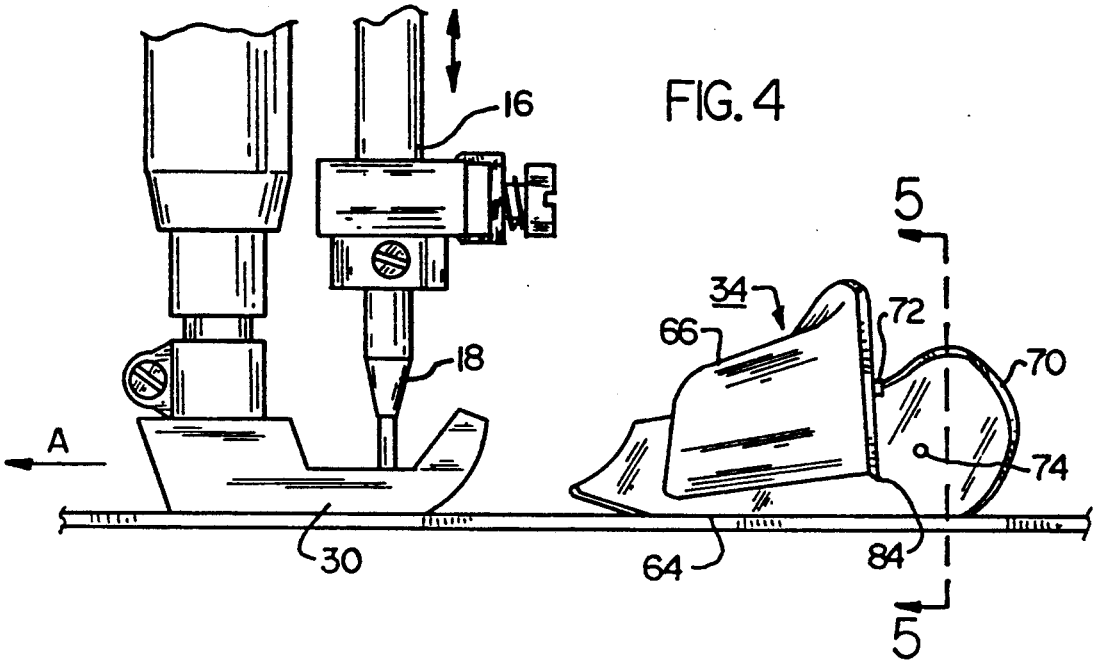
FIG. 4 is an enlarged side elevational view of the preferred embodiment of the edge detector of the present invention, as shown in FIG. 1.

Turning now to FIG. 4, an enlarged side elevated view of the preferred embodiment of the edge detector assembly 34 of the present invention, as shown in FIG. 1, is illustrated. Felling folder 28 includes a base 64 having an upper scroll member 66 and a lower scroll member 70. The felling folder 28 can be any conventional type of folders, for example, the folder described in U.S. Pat. No. 2,096,330, the entire disclosure of which is hereby incorporated by reference. A first edge detector assembly 72 is mounted to upper scroll member 66 and a second edge detector assembly 74 is attached to lower scroll member 70.

Figure 5:
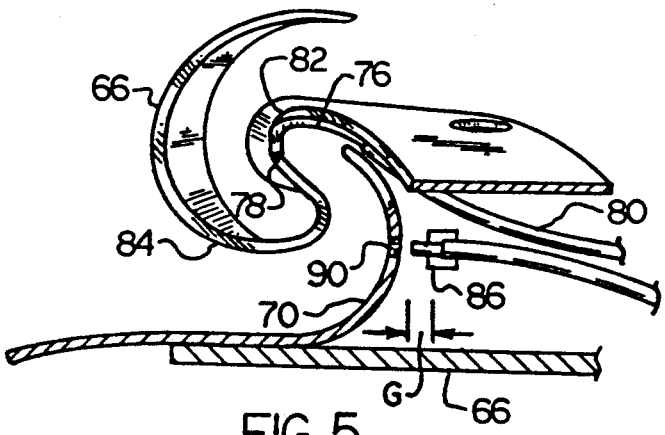
FIG. 5 is a side sectional view of the edge detector of FIG. 4 taken along line 5—5.

As best seen in FIG. 5, a sectional view of the edge detector 34 in FIG. 4, taken along line 5—5, is shown. The first edge detector assembly 72 includes a mounting tube 76 having a 90° bend 82 and formed of a suitable material, such as 1/16" I.D. brass tubing, which is brazed to the leading edge of upper scroll member 66. The open end of mounting tube 76 forms a view port 78 for first edge detector assembly 72. A first bifurcated fiber optic cable 80 is inserted into mounting tube 76 and held in place there by curvature 82. Mounting tube 76 also guards the exposed end of cable 80 to prevent cloth abrasions. Depending on the geometry of felling folder 28, an aperture or recess 84 may be made through upper-ply scroll member 66 opposite the first edge detector view port 78, thereby preventing any spurious reflection from the inner surface of the upper scroll member 66.

Second edge detector assembly 74 includes a second tubular mounting bracket 86 located adjacent to lower scroll member 70. A second bifurcated fiber optic cable 88 is held in place by tubular mounting bracket 86. A second edge detector view port 90 is located in the lower scroll member 70 adjacent to mounting bracket 86. In the preferred embodiment, the end of the second bifurcated fiber optic cable 88 is offset distance "G" from lower-ply scroll 70 in order that light from photodiode 42 may diffuse to illuminate a sufficiently large area of workpiece 32 such that reflected light may be detected by detector 44. Preferably "G" is greater than or equal to 1/32". Because of the internal geometry of the felling folder 34, the end of the first fiber optic cable 80 is already sufficiently offset from the inner surface of the upper scroll member 66.

Bifurcated fiber optic cables 80, 88 allow light source 42 and photodetector 44 to be remotely located from felling folder 28 and also provides sufficient flexability to permit folder 28 to be shifted by the operator during the loading and sewing operation. Suitable fiber optic cables are available commercially from Banner Engineering Corporation, in Minneapolis, Minn. under Model Nos. BMAP.753P and PBT26U, respectively. The first fiber optic cable 80 is preferably low loss glass and the second fiber optic cable 88 can be medium loss plastic since the gap "G" between the end of the second bifurcated cable 88 and the workpiece 32 is sufficiently small to produce a high output signal 36. Both cables should be glass if infrared light is used due to the high loss factor associated with plastic fiber optics in the infrared region.

Figure 6:
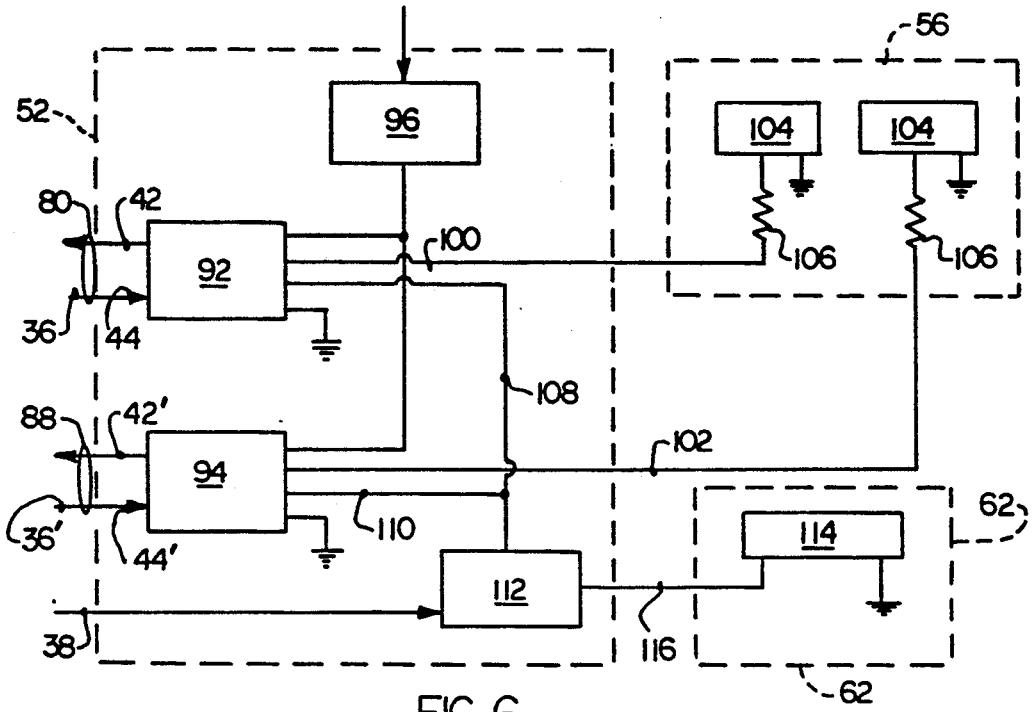
FIG. 6 is a diagrammatic view of the preferred embodiment of the control circuit shown in FIG. 3.

Reference is now made to FIG. 6, where a diagrammatic view of preferred embodiment of the control circuit 50, as shown in FIG. 3, is illustrated. Controller 52 includes a first fiber optic sensor assembly 92 and a second fiber optic sensor assembly 94. Fiber optic sensor assemblies 92, 94 include light source 42 and photodetector 44 as an integral unit. One such unit, which includes a variable photodetector, is available commercially from Banner Engineering Corporation, in Minneapolis, Minn. as Model No. SM312FP Fiber optic sensor assemblies 92, 94 receive output signals 36, 36' along bifurcated fiber optic cables 80, 88, respectively. A first fiber optic sensor output 100 and a second fiber optic sensor first output 102 are connected to two-color LED indicator 104 in series with a 2.7K-ohm resistors 106 to its red and green inputs, respectively. Then the red light of LED 104 is activated when the upper-ply is out of position and the green light of LED 104 is activated when the lower-ply is out of position. A suitable two-color LED indicator is available from Archer Electronics, a division of Tandy Corp. of Fort Worth, Tex., as its Model No. 276-025. The first fiber optic sensor 92 second output 108 and the second fiber optic sensor 94 second output 110 both are connected to the input of time delay relay 112. Time delay relay 112 is also connected to second output 38 from treadle switch 22. Thus, time delay relay 112 will be activated only when at least one ply is out of position and treadle switch 22 is depressed by the operator. Time delay relay 112 is preferably set at ½ second. The output 116 from time delay relay 112 is connected to buzzer 114. Suitable units are available commercially from National Control Corporation of Lombard, Ill. as its Model No. QIF-0005-317 and Archer Electronics as its Model No. 273-060, respectively.

In operation, as the operator guides the fabric workpiece 32 through folder 28, the first and second edge detector assemblies 72, 74, mounted to the upper and lower-ply scroll members 66, 70, provide output signals 36, 36', which are indicative of the presence of the fabric workpiece 32 in the felling folder 28. output signals 36, 36' are received by a controller 52. Controller 52 also receives a second control signal 38 from drive control switch 24. In the event that output signals 36, 36' indicate the absence of workpiece 32 and switch 24 is activated, controller 52 provides a third output signal 54 to visual alarm means 52 and, at the same time, provides a fourth output signal 60 to audio alarm means 62, thereby alerting the operator. Buzzer 114 of audio alarm 62 will be activated if either the upper or lower plys are out of position, however, the delay provided by the time delay relay 112 permits the operator time to reload and observe the indicator lights without the buzzer being activated. Thus, small flickers will not cause an audio alarm.

Thus, the control system of the present invention provides two levels of feedback to the operator. The red/green LED 104 provides a visual signal at any instant of an out-of-position condition in the upper and lower plys, respectively. In addition, if either one of the plys are out-of-position for more than ½ second, buzzer 114 provides an audio signal to the operator. Finally, the operator will also note that both lights will be activated when the final portion of the lap seam passes out of the folder 28 and clears the edge detectors 92, 94 and the last one or two inches are passing under the machine head.

Certain modifications and improvements will occur to those skilled in the art on reading the foregoing description. By way of example, additional edge detectors may be used to sense smaller changes in the position of the workpiece fabric through the folder. Also, the output from the controller can be utilized to accumulate data on the performance of individual operators as a quality control measure. Finally, a finger guard can be added to the folder to prevent false triggering of the detector by the operator. All such modifications and improvements are probably within the scope of the following claims.

We claim:

1. An apparatus for detecting the presence of a workpiece of cut fabric in a textile folding or guiding device having a work surface wherein the workpiece is processed by a sewing machine having a work surface over which the workpiece is progressively moved, comprising:

(a) an electromagnetic radiation source for directing radiation upon said workpiece;

(b) a detector for receiving radiation reflected from said workpiece and providing an output signal in response to said reflected radiation, said output signal indicating the presence of said workpiece; and (c) non-reflecting means provided on the work surface and arranged opposite said source for attenuating radiation from said source when the workpiece is not present.

2. The apparatus according to claim 1, wherein said source is mounted adjacent to one surface of said workpiece.

3. The apparatus according to claim 1, wherein said detector is located adjacent to said source.

4. The apparatus according to claim 3, wherein said detector is positioned at a distance from said surface substantially equal to the focal length of said detector.

5. The apparatus according to claim 1, wherein said source is operable in the visible red spectrum.

6. The apparatus according to claim 5, wherein said source is a light emitting diode.

7. The apparatus according to claim 5, wherein said detector is predominantly responsive to the visible red spectrum of said light source, thereby preventing said detector from providing said output signal in response to light received from non-visible red sources.

8. The apparatus according to claim 1, wherein said non-reflecting means provided on the work surface is a matt finish.

9. The apparatus according to claim 1, wherein said non-reflecting means provided on the work surface is an anodized finish.

10. The apparatus according to claim 1, wherein said non-reflecting means provided on the work surface is an aperture.

11. The apparatus according to claim 1, wherein said non-reflecting means provided on the work surface is of greater cross-sectional area than that of said radiation.

12. A sensor for detecting the position of a workpiece of cut fabric processed by a sewing machine having a work surface over which the workpiece is progressively moved, comprising:

(a) a light source for directing light upon said workpiece;

(b) a detector for receiving light reflected from said workpiece and providing an output signal in response to said reflected light, said output signal indicating the position of said workpiece; and (c) non-reflecting means provided on the work surface and arranged opposite said source for attenuating light from said source when the workpiece is not present.

13. The apparatus according to claim 12, wherein said light source is mounted adjacent to one surface of said workpiece.

14. The apparatus according to claim 13, wherein said light detector is located adjacent to said light source.

15. The apparatus according to claim 14, wherein said light detector is positioned at a distance from said surface substantially equal to the focal length of said detector.

16. The apparatus according to claim 12, wherein said light source is operable in the visible red spectrum.

17. The apparatus according to claim 16, wherein said light source is a light emitting diode.

18. The apparatus according to claim 16, wherein said detector is predominantly responsive to the visible red spectrum of said light source, thereby preventing said detector from providing said output signal in response to light received from non-visible red sources.

19. The apparatus according to claim 12, wherein said non-reflecting means provided on the work surface is a matt finish.

20. The apparatus according to claim 12, wherein said non-reflecting means provided on the work surface is an anodized finish.

21. The apparatus according to claim 12, wherein said non-reflecting means provided on the work surface is an aperture.

22. The apparatus according to claim 12, wherein said non-reflecting means provided on the work surface is of greater cross-sectional area than that of said light.

23. The apparatus according to claim 12, wherein said work surface is a feed-through folder.

24. The apparatus according to claim 23, wherein said feed-through folder is a felling folder.

25. The apparatus according to claim 12 including fiber optic means capable of transmitting the light from said light source and directing the light upon said workpiece.

26. The apparatus according to claim 12 including fiber optic means capable of receiving the light reflected from said workpiece and transmitting the reflected light to said detector.

27. A system for detecting the position of a workpiece of cut fabric processed by a sewing machine having a work surface over which the workpiece is progressively moved, comprising:

(a) a light source for directing light upon said workpiece;

(b) a light detector for receiving light reflected from said workpiece and providing an output signal in response to said reflected light, said output signal indicating the position of said workpiece;

(c) a control unit connected to said light detector for providing a display signal in response to said output signal; and (d) non-reflecting means provided on the work surface and arranged opposite said source for attenuating light from said source when the workpiece is not present.

28. The apparatus according to claim 27, wherein said light source is mounted adjacent to one surface of said workpiece.

29. The apparatus according to claim 28, wherein said light detector is located adjacent to said light source.

30. The apparatus according to claim 29, wherein said light detector is positioned at a distance from said surface substantially equal to the focal length of said detector.

31. The apparatus according to claim 27, wherein said light source is operable in the visible red spectrum.

32. The apparatus according to claim 31, wherein said light source is a light emitting diode.

33. The apparatus according to claim 31, wherein said detector is predominantly responsive to the visible red spectrum of said light source thereby preventing said detector from providing said output signal in response to light received from non-visible red sources.

34. The apparatus according to claim 27, wherein said non-reflecting means provided on the work surface is a matt finish.

35. The apparatus according to claim 27, wherein said non-reflecting means provided on the work surface is an anodized finish.

36. The apparatus according to claim 27, wherein said non-reflecting means provided on the work surface is an aperture.

37. The apparatus according to claim 27, wherein said non-reflecting means provided on the work surface is of greater cross-sectional area than that of said light.

38. The apparatus according to claim 27, wherein said work surface is a feed-through folder.

39. The apparatus according to claim 38, wherein said feed-through folder is a felling folder.

40. The apparatus according to claim 27, including fiber optic means capable of transmitting the light from said light source and directing the light upon said workpiece.

41. The apparatus according to claim 27, including fiber optic means capable of receiving the light reflected from said workpiece and transmitting the reflected light to said detector.

42. A method for detecting the presence of a workpiece of cut fabric wherein the workpiece is processed by a sewing machine having a work surface over which the workpiece is progressively moved, comprising the steps of:

(a) directing electromagnetic radiation upon said workpiece;

(b) receiving electromagnetic radiation reflected from said workpiece;

(c) attenuating said radiation when said workpiece is not present; and (d) providing an output signal in response to said reflected radiation, said output signal indicating the presence of said workpiece.

43. A method for detecting the position of a workpiece of cut fabric processed by a sewing machine having a work surface over which the workpiece is progressively moved, comprising the steps of:

(a) directing light upon one surface of said workpiece;

(b) receiving light reflected from said workpiece;

(c) attenuating said light when said workpiece is not present; and (d) providing an output signal in response to said reflected light, said output signal indicating the position of said workpiece.

44. A method for controlling the position of a workpiece of cut fabric processed by a sewing machine having a work surface over which the workpiece is progressively moved, comprising:

(a) directing light upon one surface of said workpiece;

(b) receiving light reflected from said workpiece;

(c) attenuating said light when said workpiece is not present;

(d) providing an output signal in response to said reflected light, said output signal indicating the position of said workpiece; and (e) providing an alarm signal in response to said output signal.

* * * * *